US006672778B2

(12) United States Patent
Sato et al.

(10) Patent No.: US 6,672,778 B2
(45) Date of Patent: Jan. 6, 2004

(54) PHOTOSENSITIVE MATERIAL PROCESSING APPARATUS AND PHOTOSENSITIVE MATERIAL PROCESSING METHOD USING THE SAME

(75) Inventors: Tsukasa Sato, Kanagawa (JP); Yoko Usui, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/252,833

(22) Filed: Sep. 24, 2002

(65) Prior Publication Data

US 2003/0072574 A1 Apr. 17, 2003

(30) Foreign Application Priority Data

Sep. 27, 2001 (JP) ..... 2001-297647

(51) Int. Cl.[7] ..... G03D 13/00; G03D 3/02

(52) U.S. Cl. ..... 396/568; 396/578; 396/612; 396/620; 396/626; 355/75; 399/370; 399/376; 250/559.19; 356/625; 356/628; 356/634

(58) Field of Search ..... 396/567–570, 396/578, 599, 612, 620, 622, 626; 356/625, 628, 634; 250/559.19; 355/27–29, 75, 55, 56

(56) References Cited

U.S. PATENT DOCUMENTS 4,505,574 A * 3/1985 Kurata et al. ..... 250/559.19
4,506,969 A * 3/1985 Baker ..... 396/568
4,778,272 A * 10/1988 Asakura ..... 356/625
6,304,314 B1 * 10/2001 Rider et al. ..... 355/27

* cited by examiner

*Primary Examiner*—D. Rutledge
(74) *Attorney, Agent, or Firm*—Sughrue Mion, PLLC

(57) ABSTRACT

At least two (groups of) sensors forming an insertion detection sensor are offset from each other in the conveyance direction of a photosensitive material. An insertion speed, which is different for each manual insertion event, is obtained based on the time difference when sensors that have been offset from each other detect the leading end of the photosensitive material. The length of the photosensitive material in the conveyance direction thereof is accurately computed based on the insertion speed and other information. By correcting the errors due to the changeable insertion state of the photosensitive material caused by manual insertion by the operator, the process area of the photosensitive material, required for calculating the amount of replenisher to be replenished, is accurately obtained. Therefore, the amount of the replenisher is appropriately determined and the process capacity of the developer or the fixing solution can constantly be maintained at the satisfactory level.

15 Claims, 5 Drawing Sheets

PHOTOSENSITIVE MATERIAL PROCESSING APPARATUS AND PHOTOSENSITIVE MATERIAL PROCESSING METHOD USING THE SAME

BACKGROUND OF THE INVENTION

1. Field of the Invention

The present invention relates to a photosensitive material processing apparatus and a method using the same. The photosensitive material processing apparatus includes a conveyance roller pair near an insertion opening thereof. When an operator inserts a photosensitive material through the insertion opening until it is nipped by the conveyance roller pair, the photosensitive material processing apparatus processes the photosensitive material at a predetermined conveyance speed.

2. Description of the Related Art

The photosensitive material processing apparatus generally has a tray for manual feeding of a photosensitive material at the insertion opening thereof. When the operator places a photosensitive material on the tray and inserts the photosensitive material manually into the insertion opening, the conveyance roller pair that is provided near the insertion opening nips the material.

The conveyance roller pair is rotated at a predetermined conveyance line speed. After nipped by the roller pair, the photosensitive material is automatically conveyed to a processing section with processing solution and then to a drying section.

As the process advances, the processing capacity of the processing solutions such as developer and fixing solution is lowered according to the amount of the photosensitive material which has been processed (which amount will be referred to as "the process amount" hereinafter). Therefore, in order to maintain the processing capacity at the satisfactory level, a replenisher needs to be added regularly.

The amount of the replenisher to be added is conventionally computed based on detection results of sensors, which are provided in the upstream of the conveyance roller pair at the insertion opening for detecting the photosensitive material. When the operator inserts the photosensitive material manually into the insertion opening, the sensors first detect the leading end of it. As the photosensitive material is conveyed by the conveyance roller pair, the sensors then detect the trailing end of the photosensitive material. The length of the photosensitive material in the conveyance direction thereof is obtained by multiplying the time during which the sensors are detecting the photosensitive material ("detecting time") by the conveyance line speed of the conveyance roller pair.

Further, conventionally, a plurality of sensors is disposed on a line along the width direction of the photosensitive material. The width of the photosensitive material is obtained based on the number of the sensors that detect the photosensitive material.

The process amount of the photosensitive material is determined as the area of the photosensitive material which has been processed. The area of the photosensitive material is obtained by multiplying the dimensions of the photosensitive material in the conveyance direction and the width direction thereof. In the replenishing system, the obtained areas are added one by one, and when the sum of the areas has exceeded a predetermined value, a certain amount of the replenisher is replenished. As a result, the processing capacity of the processing solutions can constantly be maintained at the satisfactory level.

However, there is a problem that the aforementioned detection time, which is used for calculating the area of the photosensitive material, may not be accurate. As there is a certain distance between the positions at which the sensors are disposed and the position at which the conveyance roller pair nips the photosensitive material, the time required for the photosensitive material to travel this distance is directly influenced by the speed at which the operator inserts the photosensitive material. In other words, the time required for the material to travel this certain distance is inevitably inaccurate and thus must be corrected.

The degree of error in the detection time may not be so significant unless the operator inserts a large number of photosensitive materials. However, when the intervals between each replenishing event is relatively long, the errors in the detection time are accumulated to a significant level. Eventually, there may result in a situation in which the processing solutions are not replenished by an appropriate amount.

SUMMARY OF THE INVENTION

In view of the aforementioned facts, an object of the present invention is to provide a photosensitive material processing apparatus that corrects the errors in the detecting time of the sensors due to the difference in the insertion state of the photosensitive material caused by manual insertion by the operator, and accurately obtains the process area of the photosensitive material required for calculating the amount of the replenisher to be replenished.

A first aspect of the present invention is a photosensitive material processing apparatus including a conveyance roller pair disposed near an insertion opening, which nips the leading end of a photosensitive material, and transports the photosensitive material at a predetermined conveyance speed ($V_R$) when the photosensitive material is inserted until it is nipped by the conveyance roller pair, the photosensitive material processing apparatus comprising: (a) a plurality of sensors for detecting the photosensitive material, the sensors being disposed in the upstream of the conveyance roller pair along the width direction of the photosensitive material and being divided into at least two groups that are offset from each other in the conveyance direction of the photosensitive material; (b) process area computing means for computing a process area of the photosensitive material based on the detection results of the sensors; and (c) correcting means for correcting a photosensitive material detecting time (X) during which the photosensitive material has been detected by a reference sensor group by using detecting time difference ($\Delta t$) between sensors that are offset, and thus correcting an error in computation by the process area computing means, the errors being caused by variance in insertion time during which the photosensitive material is conveyed from the sensors to the conveyance roller pair.

According to the first aspect, the offset state of the sensors results in detecting time difference ($\Delta t$) between the offset sensors when the photosensitive material is inserted. An insertion speed ($V_H$) of the photosensitive material is obtained from the detecting time difference ($\Delta t$) and the offset distance ($L_{OS}$). An insertion time is computed based on the insertion speed ($V_H$) and the known insertion distance ($L_{IN}$) from the sensors to the conveyance roller pair. Thereafter, the process area of the photosensitive material is obtained accurately by eliminating the effect of the difference in the insertion time and computing the accurate process area by the process area computing means.

A second aspect of the present invention is a photosensitive material processing apparatus including a conveyance roller pair disposed near an insertion opening, which nips the leading end of a photosensitive material, and transports the photosensitive material at a predetermined conveyance speed ($V_R$) when the photosensitive material is inserted until it is nipped by the conveyance roller pair, the photosensitive material processing apparatus comprising: (a) a plurality of sensors for detecting the photosensitive material, the sensors being disposed in the upstream of the conveyance roller pair along the width direction of the photosensitive material, being able to detect photosensitive materials having different sizes in the width direction thereof, and being divided into at least two groups that are offset from each other in the conveyance direction of the photosensitive material; (b) storing means for storing in advance an offset distance ($L_{OS}$) between a first sensor group and a second sensor group adjacent thereto in the conveyance direction, and a conveyance distance ($L_{IN}$) between a reference sensor group as one of the sensor groups and the position at which the conveyance roller pair nips the photosensitive material; (c) insertion time computing means for computing an insertion speed ($V_H$) of the photosensitive material from a detecting time difference ($\Delta t$) between the detecting time of the first sensor group and the detecting time of the second sensor group, and an offset distance ($L_{OS}$) between the first and second sensor groups, and then computing an insertion time required for the photosensitive material to be conveyed at the insertion speed ($V_H$) by the conveyance distance ($L_{IN}$); (d) means for computing the length (L) of the photosensitive material in the conveyance direction thereof by multiplying the time, that is obtained by subtracting the insertion time ($L_{IN}/V_H$) from the detecting time (X) during which the photosensitive material has been detected by the reference sensor group, by the conveyance speed of the conveyance roller pair ($V_R$) and then adding thereto the conveyance distance ($L_{IN}$); (e) means for determining the length (W) of the photosensitive material in the width direction thereof based on the detection results of the plurality of sensors; and (f) process area computing means for computing the process area (S) of the photosensitive material from the computed length (L) of the photosensitive material in the conveyance direction thereof and the determined length (W) of the photosensitive material in the width direction thereof.

Photosensitive materials of many widths may be used in the present invention. In the second aspect, the sensors are disposed or selected so that at least two sensors that are offset in the conveyance direction of the photosensitive material correspond with each width of the photosensitive material. For example, when the photosensitive material is inserted in a left- or right-end-aligned manner, it suffices to provide or select a sensor located at the reference end and a sensor adjacent (in the width direction of the photosensitive material) thereto. When the photosensitive material is inserted in a center-aligned (centering) manner, it suffices to provide or select a sensor located at the central position and a sensor adjacent (in the width direction of the photosensitive material) thereto.

The disposed or selected two (groups of) sensors are offset from each other by the predetermined offset distance ($L_{OS}$). The offset distance ($L_{OS}$) and a conveyance distance ($L_{IN}$), from a reference detecting position of on the most downstream-side groups to the position at which the conveyance roller pair nips the photosensitive material, are stored in advance (in storing means).

When the photosensitive material is inserted manually, the insertion speed may differ for each operator and may even differ each time at the same operator. The insertion time computing means computes the insertion speed ($V_H$) from the offset distance ($L_{OS}$) between the sensors and the detecting time difference ($\Delta t$) of the sensors that have been offset. Further, the insertion time computing means computes the insertion time ($L_{IN}/V_H$) that is the time required for the photosensitive material to be conveyed at the insertion speed ($V_H$) by the conveyance distance ($L_{IN}$).

Next, the means for computing the size of the photosensitive material in the conveyance direction thereof obtains an accurate length (L) of the photosensitive material in the conveyance direction by multiplying the time that is obtained by subtracting the insertion time ($L_{IN}/V_H$) from the detecting time (X) during which the photosensitive material has been detected by the sensors disposed at reference positions, by the line speed ($V_R$) of the conveyance roller pair, and then adding thereto the conveyance distance ($L_{IN}$) stored in the storing means.

The width (W) of the photosensitive material is determined based on the detection results of the sensors (by a means for determining the width of the photosensitive material). The process area (S) of the photosensitive material is computed accurately using the width (W) of the photosensitive material by a process area computing means.

Thus, the size of the photosensitive material in the conveyance direction thereof is accurately determined by eliminating the effect of the changeable conveyance time during which the photosensitive material is conveyed from the most downstream-side sensors to the conveyance roller pair, regardless of the difference in the insertion speed for each manual insertion event.

DESCRIPTION OF THE PREFERRED EMBODIMENT

Figure 1:
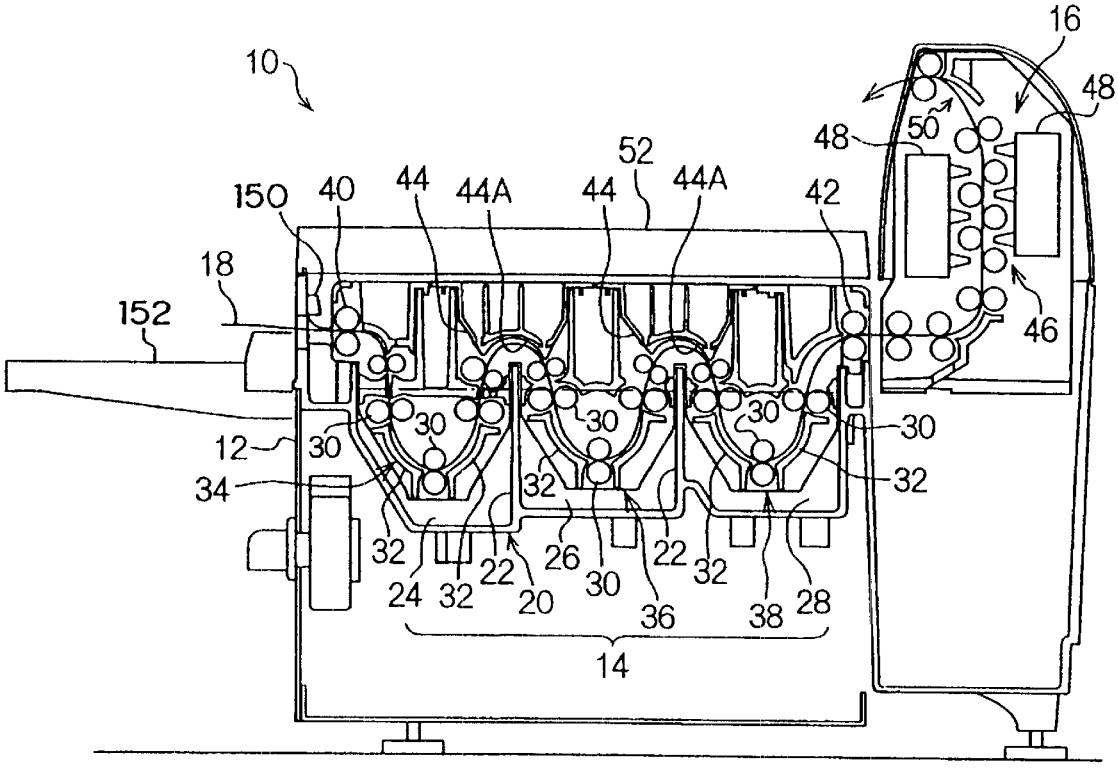
FIG. 1 schematically illustrates an automatic developing apparatus of the present embodiment.
Figure 2:
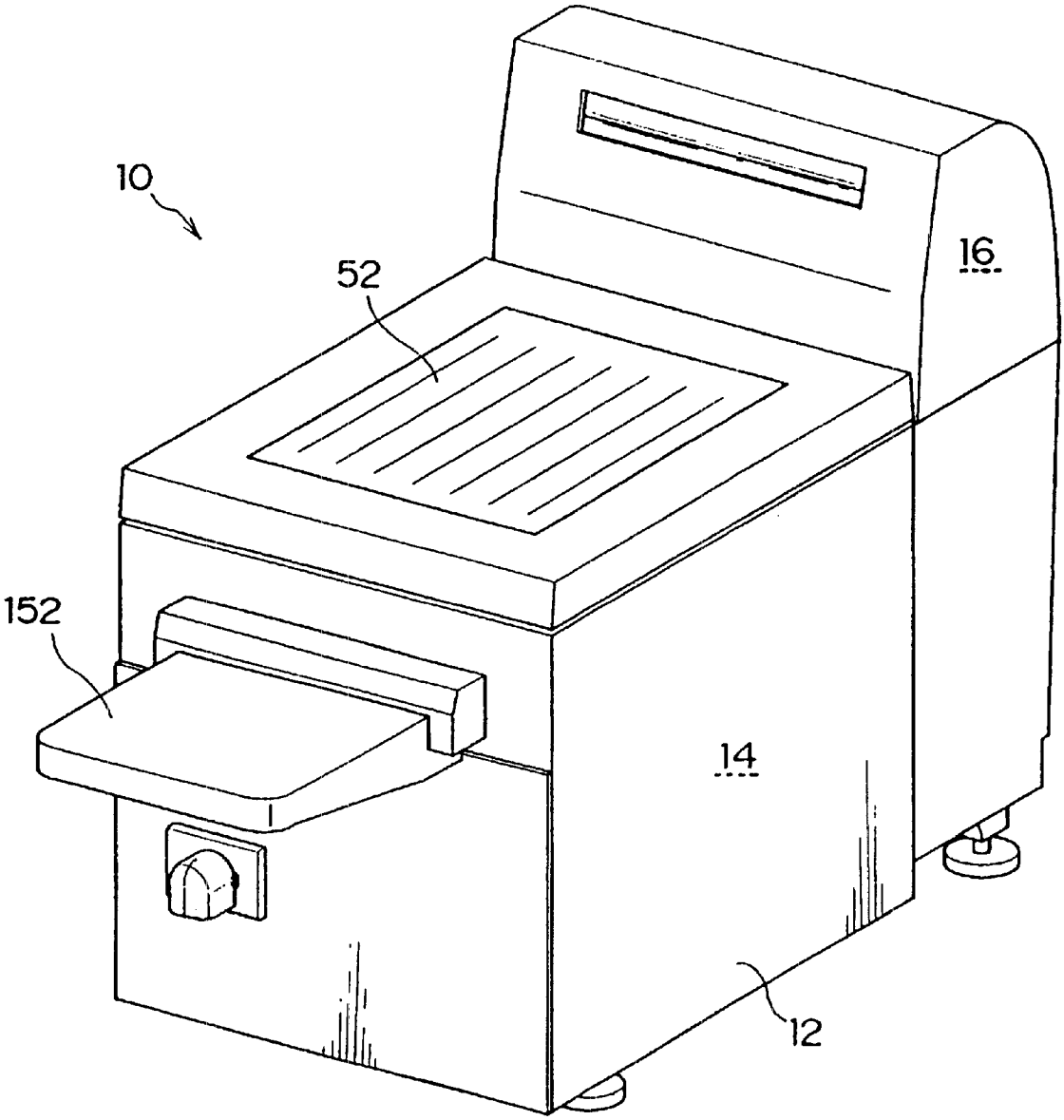
FIG. 2 is a perspective view of the automatic developing apparatus of the present embodiment.

FIGS. 1 and 2 schematically illustrate an automatic developing apparatus 10 of the present embodiment. The developing apparatus 10 includes a processing section 14 with processing solution and a drying section 16, which are covered by a casing 12. The developing apparatus 10 develops a sheet film 18 with an image printed thereon.

The processing section 14 has a process tank 20. The process tank is divided by partition boards 22 into a developing tank 24 with a developer, fixing tank 26 with a fixing solution, and a washing tank 28 with washing water. Each tank 24, 26 or 28 has a process rack 34, 36 or 38, which includes a plurality of roller pairs 30 and a guide 32. The process racks 34, 36 and 38 altogether form a conveyance path of the sheet film 18.

An insertion roller pair 40 is disposed in the upstream of the developing tank 24. A squeezing section 42 for squeezing water from the sheet film 18 is provided in the process rack 38 of the washing tank 28. Crossover racks 44 are provided between the developing tank 24 and the fixing tank 26, and between the fixing tank 26 and the washing tank 28. The sheet film 18 is guided and carried on a crossover guide 44A of the crossover rack 44.

The sheet film 18 is processed with processing solutions in the processing section 14. Inserted from between the insertion roller pair 40, the sheet film 18 is sequentially immersed in the developer, the fixing solution, and the washing water. The sheet film 18 is then fed to the drying section 16, with the moisture on the surface thereof being removed by the squeezing section 42.

In the drying section 16, a group of rollers 46, consisting of many rollers arranged in a zigzag pattern, forms a conveyance path that conveys the sheet film 18 upward. The drying section 16 dries the surface of the sheet film 18 by, while conveying the sheet film 18, blasting dry air from a hot air blasting section 48 thereon. The dry air is generated by a dry air generating means (not shown). The dried sheet film 18 is fed to a turning section 50 and discharged on a discharge tray 52 disposed on top of the processing section 14.

As shown in FIG. 1, an insertion detection sensor 150 is provided in the upstream of the insertion roller pair 40. The insertion detection sensor 150 detects the leading end of the sheet film 18 when the film is manually fed from an insertion tray 152.

Figure 3:
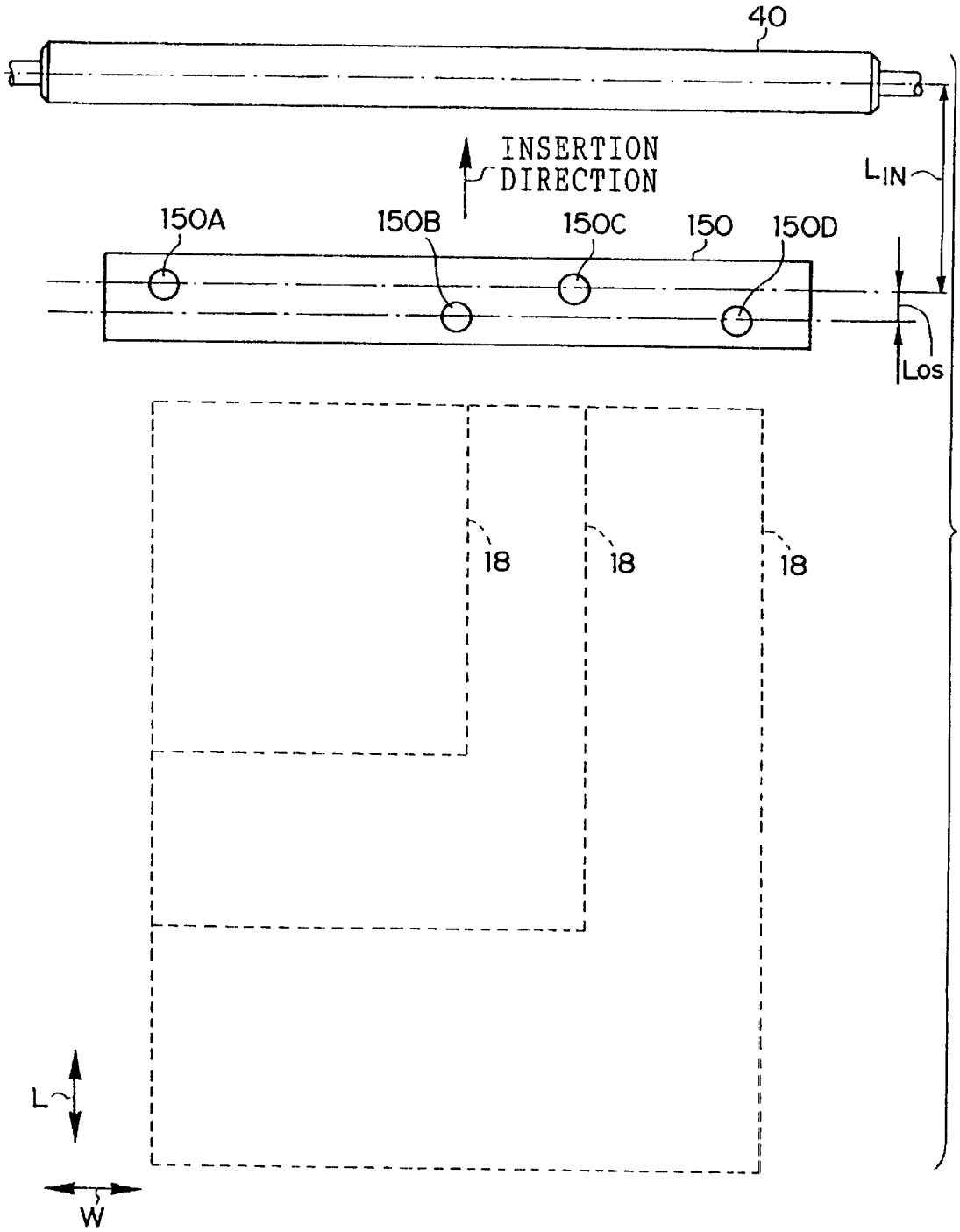
FIG. 3 is a plan view showing relative positions of an insertion detection sensor and a pair of insertion rollers.

As shown in FIG. 3, the insertion detection sensor 150 is formed from first to fourth sensors 150A, 150B, 150C and 150D that are disposed along the width direction of the sheet film 18. In the present embodiment, the sheet film 18 is inserted in a left end-aligned manner as shown in FIG. 3. The first sensor 150A is disposed so as to detect the left end of the sheet film 18. The second through fourth sensors 150B through 150D are disposed so as to correspond with each (standardized) size of sheet film 18 in the width direction thereof.

When the sheet film 18 is inserted, the insertion detection sensor 150 determines the size W of the sheet film 18 in the width direction thereof from the number of the sensors detecting the sheet film 18. In the present embodiment, the sensor 150 determines at least three sizes W.

Figure 4:
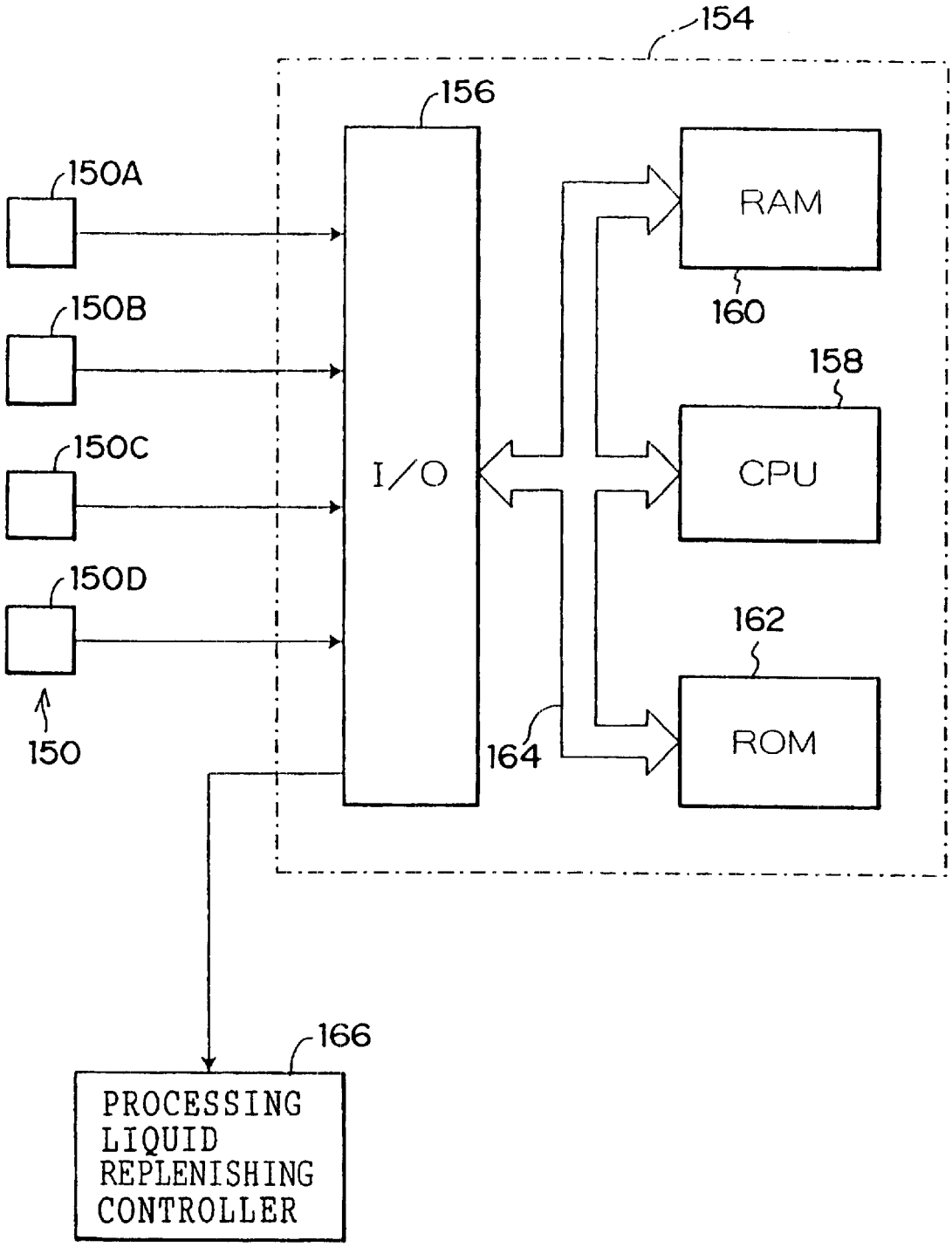
FIG. 4 is a control block diagram showing a process area computing section.

As shown in FIG. 4, a process area computing section 154 includes an I/O 156, a CPU 158, a RAM 160, and a ROM 162. A bus 164 such as a data bus and a control bus connects these components. Signal wires of the sensors 150A, 150B, 150C and 150D are connected to the I/O 156.

In the present embodiment, as shown in FIG. 3, the second and the fourth sensors 150B and 150D are offset with respect to the first and the third sensors 150A and 150C as reference sensors, toward the upstream of the conveyance direction of the sheet film 18 (offset distance: $L_{OS}$).

The offset distance $L_{OS}$ is stored in advance in the ROM 162 together with an insertion distance $L_{IN}$ between a position at which the first and the third sensors 150A and 150C, which are the reference sensors, detect the sheet film 18 and a position at which the insertion roller pair 40 nips the sheet film 18.

An equation (i.e., the equation (1) below) is stored in the ROM 162, which is used for computing the size L of the sheet film 18 in the conveyance direction thereof. The CPU 158 computes the size L (length) of the sheet film 18 using the information stored in the ROM 162, such as the offset distance $L_{OS}$, the insertion distance $L_{IN}$, and the conveyance line speed $V_R$ of the insertion roller pair 40. The area (i.e., the process area) of the sheet film 18 is obtained by multiplying the thus-determined length L by the width W of the sheet film 18.

Before computing the process area, the CPU 158 computes the detecting time difference Δt between the time when the first and the third sensors 150A and 150C detect the leading end of the sheet film 18 and the time when the second and the fourth sensors 150B and 150D, which are offset with respect to the first and the third sensors 150A and 150C, detect the same. Then, based on the detecting time difference Δt, the CPU 158 computes the insertion speed $V_H$ in the section between the first sensor 150A and the insertion roller pair 40.

The sheet film 18 is inserted manually at different insertion speed each time. Accordingly, the insertion speed $V_H$ is determined for each insertion event, based on the detecting time difference Δt between the sensors that are offset.

The length L is computed using the following equation (1) based on the conveyance speed $V_R$ of the insertion roller pair 40, the insertion distance $L_{IN}$, and the insertion speed $V_H$ ($V_H = L_{OS}/\Delta t$).

$$L = (X - L_{IN}/V_H) \times V_R + L_{IN} \quad (1)$$

wherein X represents the time period between the time when the first sensor 150A, which is the reference sensor, detects the leading end of the sheet film 18 and the time when the first sensor 150A detects the trailing end of the sheet film 18.

The computation result at the process area computing section, i.e., the multiplied value S of the length L and the width W of the sheet film 18 computed by the equation (1) is transmitted to a processing liquid replenishing controller 166. The processing liquid replenishing controller 166 regularly sends signals to a replenisher supplying system (not shown) so as to replenish the developing tank 24 and the fixing tank 26 with the replenisher of the amount in accordance with the process area.

Operation of the present embodiment will be described below.

After inserted by the operator, the sheet film 18 advances into the developer in the developing tank 24 substantially vertically with respect to the liquid level, and then reaches the bottom of the developing tank 24.

The sheet film 18 is then moved upward and leaves the developer substantially vertically from the liquid level.

During this step, the sheet film 18 is immersed in the developer and undergoes a predetermined development for the period of time determined by the length of the substantially U-shaped conveyance path and the conveyance speed.

After discharged from the developing tank 24, the sheet film 18 is carried on the crossover guide 44A of the crossover rack 44 to the adjacent fixing tank 26. The sheet film 18 passes through the fixing solution along the similar conveyance path to that in the developing tank 24.

Subsequently, the sheet film 18 is carried on the crossover guide 44A to the adjacent washing tank 28, and passes through the washing water along the similar conveyance path to those in the developing tank 24 and the fixing tank 26.

Then, the sheet film 18 is carried to the drying section 16, where it is dried by dry air blasting thereto. The sheet film 18 is finally discharged onto the discharge tray 52.

After the sheet film 18 is discharged, in the present embodiment, the developing tank 24 or the fixing tank 26 is replenished with replenisher of an appropriate amount in accordance with the process amount of the sheet film 18. With this replenishing step, the process capacity of the developer or the fixing solution can constantly be maintained at the satisfactory level.

The process amount corresponds with the process area of the sheet film 18. Therefore, the process area computing section 154 determines the process amount by adding the process areas of the sheet films 18 that are subsequently inserted one by one.

The size W of the sheet film 18 in the width direction thereof is determined based on the detection results of the four sensors 150A through 150D that are disposed along the width direction of the sheet film 18. That is, when the sheet film 18 is inserted in a left end-aligned manner as shown in FIG. 3, the first and the second sensors 150A and 150B detect the sheet film 18 without fail.

On the other hand, the third and the fourth sensors 150C and 150D may or may not detect the sheet film 18 depending on the size of the sheet film 18. From the detection result of these sensors 150A through 150D, the size W of the sheet film 18 in the width direction thereof is determined.

The size L of the sheet film 18 in the conveyance direction thereof is basically obtained by multiplying the time period between the time when the first sensor 150A detects the leading end of the sheet film 18 and the time when the first sensor 150A detects the trailing end of the same, by the conveyance speed of the insertion roller pair 40. Actually, however, the sheet film 18 is manually inserted and the insertion speed in the section from the position where the first sensor 150A detects the leading end of the sheet film 18, to the position where the insertion roller pair 40 nips the sheet film 18, may differ for each insertion event and is not likely to be equal to the conveyance line speed. Although the error in each insertion event is not so significant, the accumulated errors will critically affect the amount of replenisher to be replenished. As a result, the processing solutions may not be filled by an appropriate amount.

Figure 5:
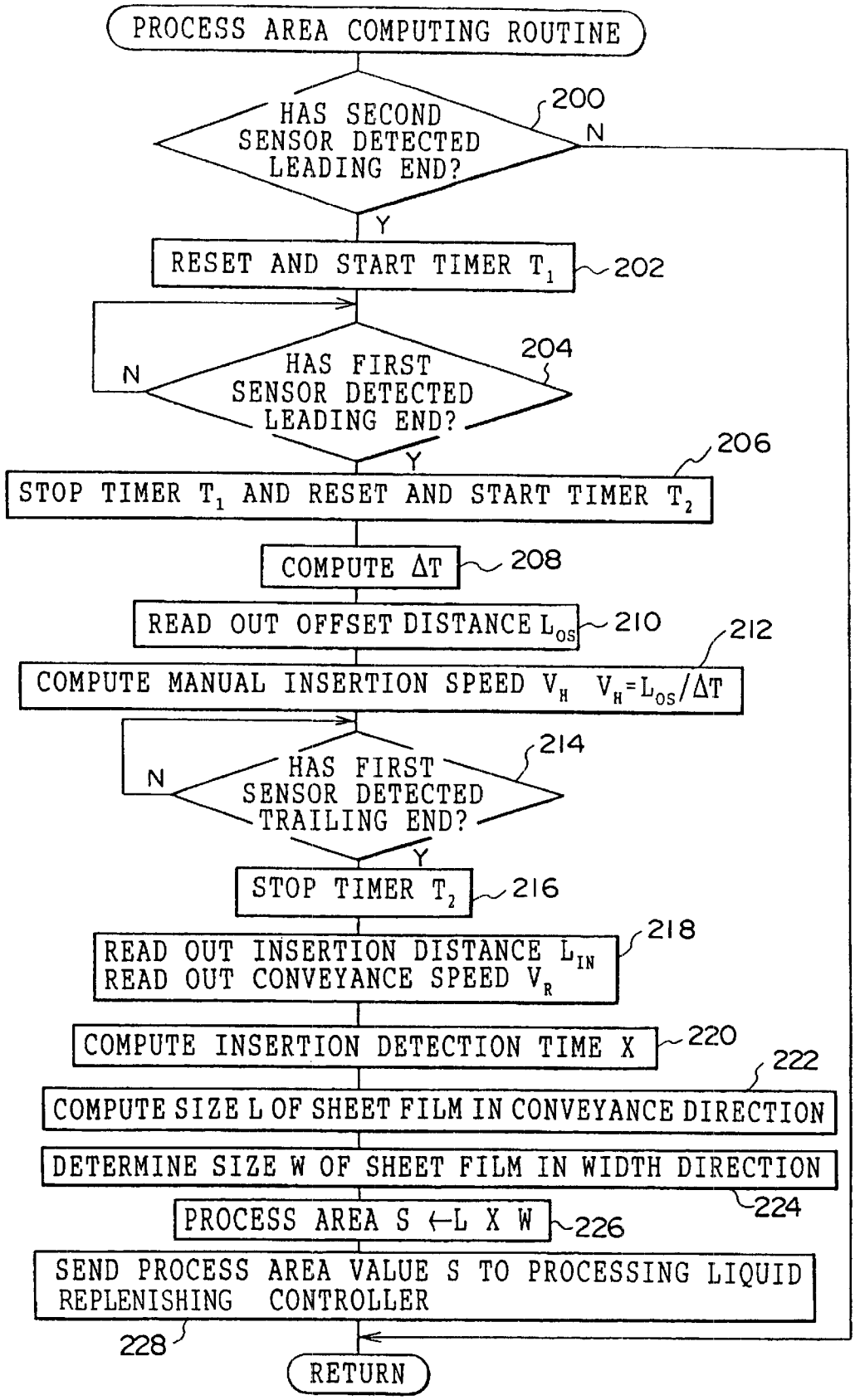
FIG. 5 is a control flowchart illustrating a routine for computing the length and width of a sheet film in the process area computing section.

To solve this, in the present embodiment, the CPU 158 computes the insertion speed of the sheet film 18 for each manual insertion event, to accurately obtain the size L of the sheet film 18 in the conveyance direction thereof. Now, referring to the flowchart in FIG. 5, the process area computing routine including the computation of the length of the sheet film in the conveyance direction thereof will be described.

In step 200, it is determined whether the second sensor 150B has detected the leading end of the sheet film 18. When the result is affirmative, the routine proceeds to step 202, where a timer $t_1$ is reset and made to start. The routine proceeds to step 204.

In step 204, it is determined whether the first sensor 150A has detected the leading end of the sheet film 18. Because the first sensor 150A is offset with respect to the second sensor 150B toward the conveyance direction of the sheet film 18, there is time difference between the times at which the first and the second sensors 150A and 150B detect the leading end of the sheet film 18. When the result of step 204 is affirmative, the routine proceeds to step 206, where the timer $t_1$ is stopped and the timer $t_2$ is reset and made to start. Then, in step 208, the time difference Δt that is the count value of the timer $t_1$ is computed.

Next, in step 210, the offset distance $L_{OS}$ is read out. In step 212, the manual insertion speed $V_H$ is computed from the detecting time difference (Δt) between the first and the second sensors 150A and 150B, and the offset distance $L_{OS}$.

Next, in step 214, it is determined whether the first sensor 150A, which is the reference sensor, has detected the trailing end of the sheet film 18.

When the result is affirmative, the routine proceeds to step 216, where the timer $t_2$ stops. Then, the routine proceeds to step 218.

In step 218, the insertion distance $L_{IN}$ and the conveyance speed $V_R$ are read out. Then, the routine proceeds to step 220, where the insertion detecting time X is computed. The insertion detecting time X is the count value of the timer $t_2$.

Next, in step 222, the size L of the sheet film 18 in the conveyance direction thereof is computed using the equation (1) below.

$$L=(X-L_{IN}/V_H)\times V_R+L_{IN} \quad (1)$$

wherein L: the size (length) of the sheet film 18 in the conveyance direction thereof; $V_R$: the conveyance speed of the insertion roller pair 40; $L_{IN}$: insertion distance; $V_H$: insertion speed; and X: the time period between the time when the first sensor 150A detects the leading end of the sheet film 18 and the time when it detects the trailing end of the sheet film 18.

Next, in step 224, the size W of the sheet film 18 in the width direction thereof is determined based on the detection results of the first through the fourth sensors 150A through 150D. Then, in step 226, the process area S is computed (L×W).

In step 228, the obtained process area S is sent to the processing liquid replenishing controller 166. The processing liquid replenishing controller 166 computes the appropriate amount of the replenisher in accordance with the process area S.

As described above, in the present embodiment, at least two of the four sensors 150A through 150D forming the insertion detection sensor 150 are offset, with respect to other sensors, toward the conveyance direction of the sheet film 18. The insertion speed of the sheet film 18 for each manual insertion event is obtained by the detecting time difference (i.e., the difference in the time when the leading end of the sheet 18 is detected) between the sensors that are offset from each other (the first sensor 150A and the second sensor 150B in this embodiment). The size L of the sheet film in the conveyance direction thereof is accurately computed based on the thus obtained insertion speed. Therefore, the amount of the replenisher to be replenished is always appropriately determined and the process capacity of the developer or the fixing solution can constantly be maintained at the satisfactory level.

In the present embodiment, the first and the third sensors 150A and 150C are disposed at the reference positions and the second and the fourth sensors 150B and 150D are offset therefrom in the upstream of the conveyance direction of the sheet film 18. However, the second and the fourth sensors 150B and 150D may be offset in the downstream of conveyance direction.

In the present embodiment, the detecting time difference between the first and the second sensors 150A and 150B was employed as the detecting time difference (Δt). However, the detecting time difference between the first and the fourth sensors 150A and 150D, the second and the third sensors 150B and 150C, or the third and the fourth sensors 150C and 150D may also be used, depending on the size of the photosensitive material.

Further, in the present embodiment, the manual insertion speed was determined from the detecting time difference between two sensors. Alternatively, three or more sensors that are offset from one another may also be used. Specifically, acceleration of the manual insertion speed may be obtained from the magnitude of the variation of the detecting time difference between the first and the second sensors (Δt), and the second and the third sensors (Δt').

As described above, the present invention has an excellent effect in correcting the errors (variation) in the detecting time of the sensors due to the errors in the insertion state of the photosensitive material caused by manual insertion by the operator, and accurately obtaining the process area of the photosensitive material required for calculating the amount of the replenisher to be replenished.

What is claimed is:

1. A photosensitive material processing apparatus including a conveyance roller pair disposed near an insertion opening, which roller pair nips the leading end of a photosensitive material and transports the photosensitive material at a predetermined conveyance speed ($V_R$) when the photosensitive material is inserted until it is nipped by the conveyance roller pair, the photosensitive material processing apparatus comprising:

a plurality of sensors for detecting the photosensitive material, the sensors being disposed in the upstream of the conveyance roller pair along the width direction of the photosensitive material and being divided into at least two groups that are offset from each other in the conveyance direction of the photosensitive material;

means for computing a process area of the photosensitive material based on the detection results of the sensors; and means for correcting a photosensitive material detecting time (X) during which the photosensitive material has been detected by a reference sensor group by using detecting time difference (Δt) between sensors that are offset, and thus correcting an error in computation by the process area computing means, the error being caused by variance in insertion time during which the photosensitive material is inserted from the sensors to the conveyance roller pair.

2. An apparatus according to claim 1, wherein the sensors detect the length (W) of the photosensitive material in the width direction thereof.

3. An apparatus according to claim 2, wherein the detecting time difference (Δt) is the time difference between the time when a first sensor group detects the photosensitive material and the time when a second sensor group adjacent to the first sensor group in the conveyance direction detects the photosensitive material.

4. An apparatus according to claim 3, wherein the photosensitive material detecting time (X) of the sensor is the time period between the time when the reference sensor group detects the leading end of the photosensitive material and the time when the same sensor group detects the trailing end of the photosensitive material.

5. An apparatus according to claim 4, wherein the correcting means further includes:

means for computing an insertion speed ($V_H$) of the photosensitive material from the detecting time difference (Δt) and an offset distance ($L_{OS}$) between the two sensor groups;

means for computing an insertion time ($L_{IN}/V_H$) of the photosensitive material from the insertion distance ($L_{IN}$) and the insertion speed ($V_H$), the insertion distance ($L_{IN}$) being the distance between the reference sensor group and the conveyance roller pair; and means for correcting an error in computation of the process area computing means by eliminating the effect of the insertion time.

6. An apparatus according to claim 5, wherein the elimination of the effect of the insertion time is conducted using the equation (1) below:

$$L=(X-L_{IN}/V_H)\times V_R+L_{IN} \quad (1)$$

wherein L: the length of the photosensitive material in the conveyance direction thereof; $V_R$: the conveyance speed; $L_{IN}$: the insertion distance; $V_H$: the insertion speed; and X: the time period between the time when a reference sensor group detects the leading end of the photosensitive material and the time when the same sensor group detects the trailing end of the photosensitive material.

7. An apparatus according to claim 6, wherein the process area computing means computes the process area of the photosensitive material by multiplying the length (W) of the photosensitive material in the width direction thereof by the length (L) of the same in the conveyance direction thereof.

8. An apparatus according to claim 7, which obtains detecting time difference (Δt') between the detecting time of the second sensor group and the detecting time of the third sensor group adjacent to the second sensor group in the conveyance direction, and then obtains acceleration of the insertion speed based on Δt and Δt'.

9. A photosensitive material processing apparatus including a conveyance roller pair disposed near an insertion opening, which nips the leading end of a photosensitive material and transports the photosensitive material at a predetermined conveyance speed ($V_R$) when the photosensitive material is inserted until it is nipped by the conveyance roller pair, the photosensitive material processing apparatus comprising:

a plurality of sensors for detecting the photosensitive material, the sensors being disposed in the upstream of the conveyance roller pair along the width direction of the photosensitive material, being able to detect photosensitive materials having different sizes in the width direction thereof, and being divided into at least two groups that are offset from each other in the conveyance direction of the photosensitive material;

means for storing in advance an offset distance ($L_{OS}$) between a first sensor group and a second sensor group adjacent thereto in the conveyance direction, and a conveyance direction ($L_{IN}$) between a reference sensor group as one of the sensor groups and the position at which the conveyance roller pair nips the photosensitive material;

means for computing an insertion speed ($V_H$) of the photosensitive material from a detecting time difference (Δt) between the detecting time of the first sensor group and the detecting time of the second sensor group, and an offset distance ($L_{OS}$) between the first and second sensor groups, and then computing an insertion time required for the photosensitive material to be conveyed at the insertion speed ($V_H$) by the conveyance distance ($L_{IN}$);

means for computing the length (L) of the photosensitive material in the conveyance direction thereof by multiplying the time, that is obtained by subtracting the insertion time ($L_{IN}/V_H$) from the detecting time (X) during which the photosensitive material has been detected by the reference sensor group, by the conveyance speed of the conveyance roller pair ($V_R$) and then adding thereto the conveyance distance ($L_{IN}$);

means for determining the length (W) of the photosensitive material in the width direction thereof based on the detection results of the plurality of sensors; and means for computing the process area (S) of the photosensitive material from the computed length (L) of the photosensitive material in the conveyance direction thereof and the determined length (W) of the photosensitive material in the width direction thereof.

10. An apparatus according to claim 9, wherein the photosensitive material detecting time (X) counted by the reference sensor is the time period between the time when a reference sensor group detects the leading end of the photosensitive material and the time when the same sensor group detects the trailing end of the photosensitive material.

11. An apparatus according to claim 10, wherein the length (L) of the photosensitive material in the conveyance direction thereof is computed using the equation (1) below:

$$L=(X-L_{IN}/V_H)\times V_R+L_{IN} \quad (1)$$

wherein L: the length of the photosensitive material in the conveyance direction thereof; $V_R$: the conveyance speed; $L_{IN}$: the insertion distance; $V_H$: the insertion speed; and X: the time period between the time when a reference sensor group detects the leading end of the photosensitive material and the time when the same sensor group detects the trailing end of the photosensitive material.

12. An apparatus according to claim 11, which obtains detecting time difference (Δt') between the detecting time of the second sensor group and the detecting time of the third sensor group adjacent to the second sensor group in the conveyance direction, and then obtains acceleration of the insertion speed based on Δt and Δt'.

13. A photosensitive material processing method, comprising the steps of:

(a) disposing a conveyance roller pair, which nips the leading end of a photosensitive material and rotates, near an insertion opening;

(b) disposing a plurality of sensors for detecting the photosensitive material in the upstream of the conveyance roller pair along the width direction of the photosensitive material, and offsetting at least two groups of sensors from each other in the conveyance direction of the photosensitive material;

(c) inserting a photosensitive material until it is nipped by the conveyance roller pair;

(d) obtaining a detecting time (X) during which a reference sensor group has detected the photosensitive material;

(e) reading out an offset distance ($L_{OS}$) in the conveyance direction between a first sensor group and a second sensor group adjacent thereto;

(f) reading out a detecting time difference (Δt) that is the time difference between the time when the first sensor group detects the photosensitive material and the time when the second sensor group detects the photosensitive material;

(g) computing an insertion speed $V_H$ from the offset distance ($L_{OS}$) and the detecting time difference (Δt);

(h) reading out an insertion distance ($L_{IN}$) between the reference sensor group and the position at which the conveyance roller pair nips the photosensitive material, and a conveyance speed ($V_R$) of the conveyance roller pair, the insertion distance being the distance between the reference sensor group and the conveyance roller pair;

(i) computing the length (L) of the photosensitive material in the conveyance direction thereof using the equation (1) below:

$$L=(X-L_{IN}/V_H)\times V_R+L_{IN} \quad (1)$$

wherein L: the length of the photosensitive material in the conveyance direction thereof; $V_R$: the conveyance speed; $L_{IN}$: the insertion distance; $V_H$: the insertion speed; and X: detecting time (X) during which the reference sensor group is detecting the photosensitive material;

(j) determining the length (W) of the photosensitive material in the width direction thereof based on the detection results of the sensors;

(k) computing a process area (S) of the photosensitive material from the length (L) of the photosensitive material in the conveyance direction thereof computed in step (i) and the length (W) of the photosensitive material in the width direction thereof determined in step (j); and (l) computing an appropriate amount of replenisher based on the computed process area (S).

14. A method according to claim 13, wherein the step (d) for obtaining the detecting time (X) during which the reference sensor group has detected the photosensitive material is a step for obtaining the time period between the time when the reference sensor group detects the leading end of the photosensitive material and the time when the same sensor group detects the trailing end of the photosensitive material.

15. A method according to claim 13, further comprising reading out a detecting time difference (Δt') between the detecting time of the second sensor group and the detecting time of the third sensor group, and then computing acceleration of the insertion speed based on Δt and Δt'.

* * * * *